US009161150B2

(12) United States Patent
Norimatsu et al.

(10) Patent No.: US 9,161,150 B2
(45) Date of Patent: Oct. 13, 2015

(54) AUDIO RENDERING DEVICE AND AUDIO RENDERING METHOD

(71) Applicant: Panasonic Intellectual Property Corporation of America, Torrance, CA (US)

(72) Inventors: Takeshi Norimatsu, Hyogo (JP); Kok Seng Chong, Singapore (SG); Lih Horng Tee, Singapore (SG)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 183 days.

(21) Appl. No.: 14/114,004

(22) PCT Filed: Oct. 18, 2012

(86) PCT No.: PCT/JP2012/006670

§ 371 (c)(1),
(2) Date: Oct. 25, 2013

(87) PCT Pub. No.: WO2013/057948

PCT Pub. Date: Apr. 25, 2013

(65) Prior Publication Data

US 2014/0211945 A1 Jul. 31, 2014

(30) Foreign Application Priority Data

Oct. 21, 2011 (JP) ..... 2011-232002

(51) Int. Cl.

| | |
|---|---|
| ***H04S 7/00*** | (2006.01) |
| ***H04S 1/00*** | (2006.01) |
| *H04R 1/40* | (2006.01) |

(52) U.S. Cl.

CPC . *H04S 7/00* (2013.01); *H04S 1/002* (2013.01); *H04R 1/403* (2013.01); *H04R 2201/401* (2013.01); *H04R 2499/15* (2013.01); *H04S 7/305* (2013.01); *H04S 2420/13* (2013.01)

(58) Field of Classification Search

None

See application file for complete search history.

(56) References Cited

U.S. PATENT DOCUMENTS

| | | | |
|---|---|---|---|
| 4,748,669 | A | 5/1988 | Klayman |
| 5,892,830 | A | 4/1999 | Klayman |

(Continued)

FOREIGN PATENT DOCUMENTS

| | | |
|---|---|---|
| EP | 1 209 949 | 5/2002 |
| EP | 1 225 789 | 7/2002 |

(Continued)

OTHER PUBLICATIONS

Extended European Search Report issued Mar. 17, 2015 in corresponding European patent application No. 12841137.8.

(Continued)

*Primary Examiner* — Paul Huber

(74) *Attorney, Agent, or Firm* — Wenderoth, Lind & Ponack, L.L.P.

(57) ABSTRACT

An audio rendering device which uses multichannel speakers includes: a first delay computation unit which computes, based on rendering information about the multichannel speakers, a first delay corresponding to a primary wavefront which propagates in a predetermined traveling direction from a sound source that is each of speakers included in the multichannel speakers; a second delay computation unit which computes, based on the rendering information about the multichannel speakers, a second delay corresponding to a secondary wavefront which is generated by the primary wavefront and has a scattering wavefront; an addition unit which adds up the first delay and the second delay to compute a total delay; and a delay filter which applies the total delay to an input audio signal to generate a multichannel audio signal for use in rendering with the multichannel speakers, and outputs the multichannel audio signal to the multichannel speakers.

13 Claims, 14 Drawing Sheets

(56) References Cited

U.S. PATENT DOCUMENTS

| | | | | |
|---|---|---|---|---|
| 6,928,168 | B2 | 8/2005 | Kirkeby | |
| 7,577,260 | B1 * | 8/2009 | Hooley et al. | 381/77 |
| 7,636,443 | B2 | 12/2009 | Klayman | |
| 7,801,313 | B2 | 9/2010 | Sako et al. | |
| 7,991,176 | B2 | 8/2011 | Kirkeby | |
| 2002/0118839 | A1 | 8/2002 | Schott | |
| 2004/0114774 | A1 | 6/2004 | Boone et al. | |
| 2006/0078132 | A1 | 4/2006 | Sako et al. | |
| 2008/0279401 | A1 | 11/2008 | Bharitkar et al. | |
| 2009/0136066 | A1 | 5/2009 | Johnston | |
| 2011/0194712 | A1 | 8/2011 | Potard | |
| 2012/0082319 | A1 * | 4/2012 | Jot et al. | 381/63 |

FOREIGN PATENT DOCUMENTS

| | | |
|---|---|---|
| JP | 9-121400 | 5/1997 |
| JP | 2001-513619 | 9/2001 |
| JP | 2006-114945 | 4/2006 |
| JP | 2009-231980 | 10/2009 |
| WO | 99/08479 | 2/1999 |

OTHER PUBLICATIONS

International Search Report issued Nov. 20, 2012 in International Application No. PCT/JP2012/006670.

* cited by examiner

AUDIO RENDERING DEVICE AND AUDIO RENDERING METHOD

TECHNICAL FIELD

The present invention relates to an audio rendering device and an audio rendering method which use multichannel speakers.

BACKGROUND ART

As audio devices, speaker arrays and speaker matrices are fast becoming increasingly popular. The speaker arrays and the speaker matrices are capable of bringing three-dimensional audio (3D audio) to a listener and play a very important role in the 3D entertainment. The speaker arrays and the speaker matrices enable the creation of novel aural sensations, such as virtual sources in front of or behind the speaker arrays and the speaker matrices, by the principles of wave field synthesis, to realize a wide sweet spot (the most appropriate listening position) and a wide stereo sensation. It is to be noted that in the following description, a speaker array is explained as an example, and since the same will apply to a speaker matrix, explanations thereof are merely omitted. In other words, the following explanations about a speaker array imply explanations about a speaker matrix.

Two main known principles of the wave field synthesis are a Rayleigh integral method and a beamforming method. FIG. 1A shows the principle of Rayleigh integral wave field synthesis, and FIG. 1B shows the principle of beamforming wave field synthesis.

The Rayleigh integral is used in the synthesis for a virtual source (a primary source 11) that is present behind a speaker array 10A as shown in FIG. 1A.

The use of the Rayleigh integral allows the wavefront from the primary source to be approximated by a distribution of secondary sources. To put it simply, the primary source 11 refers to the virtual source intended to be synthesized behind the speaker array 10A, and the secondary sources refer to the speaker array 10A itself as shown in FIG. 1A.

Thus, the Rayleigh integral wave field synthesis can be achieved by emulating the amplitudes and delays of the wavefront of the primary source 11 (the virtual source) arriving at each of the secondary sources (the speaker array 10A).

The beamforming is used in the synthesis for a virtual source 12 that is in front of a speaker array 10B as shown in FIG. 1B.

According to the principle of beamforming wave field synthesis, delays and gains are applied to an audio signal outputted from each channel of the speaker array 10B so that as much audio as possible overlaps at a desired virtual spot, which allows the virtual source 12 to be generated in front of the speaker array 10B as a result of the synthesis.

However, existing content is primarily reproduced using stereo sound sources.

For this reason, technologies that enable monaural sound sources or stereo sound sources with speaker arrays to generate novel aural sensation are being actively developed.

For example, Patent Literatures (PTL) 1 to 10 disclose technologies that widen stereo sound images on speaker arrays sing reverberation.

CITATION LIST

Patent Literature

[PTL 1] European Patent Application Publication No. 1225789 Description
[PTL 2] U.S. Pat. No. 4,748,669 Specification

[PTL 3] U.S. Pat. No. 5,892,830 Specification
[PTL 4] U.S. Pat. No. 6,928,168 Specification
[PTL 5] U.S. Pat. No. 7,636,443 Specification
[PTL 6] U.S. Pat. No. 7,991,176 Specification
[PTL 7] United States Patent Application Publication No. 2002/0118839 Specification
[PTL 8] United States Patent Application Publication No 2008/0279401 Specification
[PTL 9] United States Patent Application Publication No. 2009/0136066 Specification
[PTL 10] United States Patent Application Publication No. 2011/0194712 Specification

SUMMARY OF INVENTION

Technical Problem

However, the above-stated conventional technologies have a problem that the effect of the stereo sound image (such as a stereo sensation or a sense of envelopment) depends on the position of a listener.

Thus, the present invention has been devised in view of such a problem and aims to provide an audio rendering device and an audio rendering method that can provide a stereo sound image which gives a sense of presence irrespective of the position of a listener.

Solution to Problem

In order to achieve the above-stated goal, an audio rendering device according to an aspect of the present invention is an audio rendering device which uses multichannel speakers and comprises: a first delay computation unit configured to compute, based on rendering information about the multichannel speakers, a first delay corresponding to a primary wavefront which propagates in a predetermined traveling direction from a sound source that is each of speakers included in the multichannel speakers; a second delay computation unit configured to compute, based on the rendering information about the multichannel speakers, a second delay corresponding to a secondary wavefront which is generated by the primary wavefront and has a scattering wavefront; an addition unit configured to add up the first delay and the second delay to compute a total delay; and a delay filter which applies the total delay to an input audio signal to generate a multichannel audio signal for use in rendering with the multichannel speakers, and outputs the multichannel audio signal to the multichannel speakers.

It is to be noted that these generic or specific aspects may be implemented using a system, a method, an integrated circuit, a computer program, or a computer-readable recording medium such as a compact disc read only memory (CD-ROM), and may also be implemented by any combination of systems, methods, integrated circuits, computer programs, and recording media.

Advantageous Effects of Invention

According to the present invention, it is possible to provide a rendering device and a rendering method that can provide a stereo sound image which gives a sense of presence irrespective of the position of a listener.

DESCRIPTION OF EMBODIMENTS (Underlying Knowledge Forming Basis of the Present Invention)

The inventor of the present invention has found the following problems in the conventional technologies stated in the [Background Art] section.

Since existing content is still primarily reproduced using stereo sound sources, reproduction technologies that enable monaural sound sources or stereo sound sources with speaker arrays to generate novel aural sensation are being actively developed. Among the reproduction technologies that are being developed, a technology that widens a stereo sound image on a speaker array is under high expectations because this is available in 2-channel audio equipment.

The following describes a technology that further widens a stereo sound image on a speaker array (a stereo sound image widening technology).

Figure 1A:
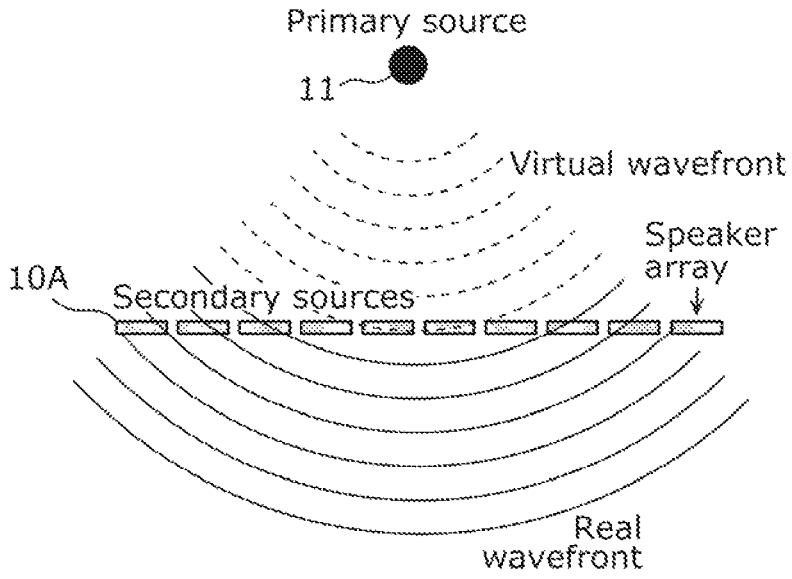
FIG. 1A shows the principle of Rayleigh integral wave field synthesis.
Figure 1B:
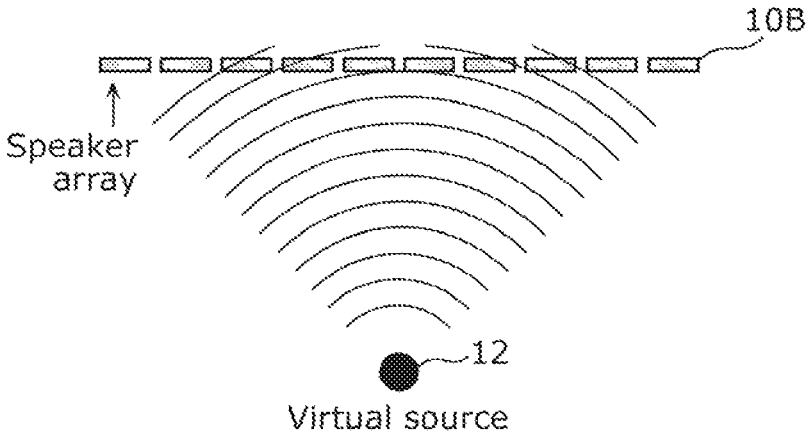
FIG. 1B shows the principle of beamforming wave field synthesis.
Figure 2:
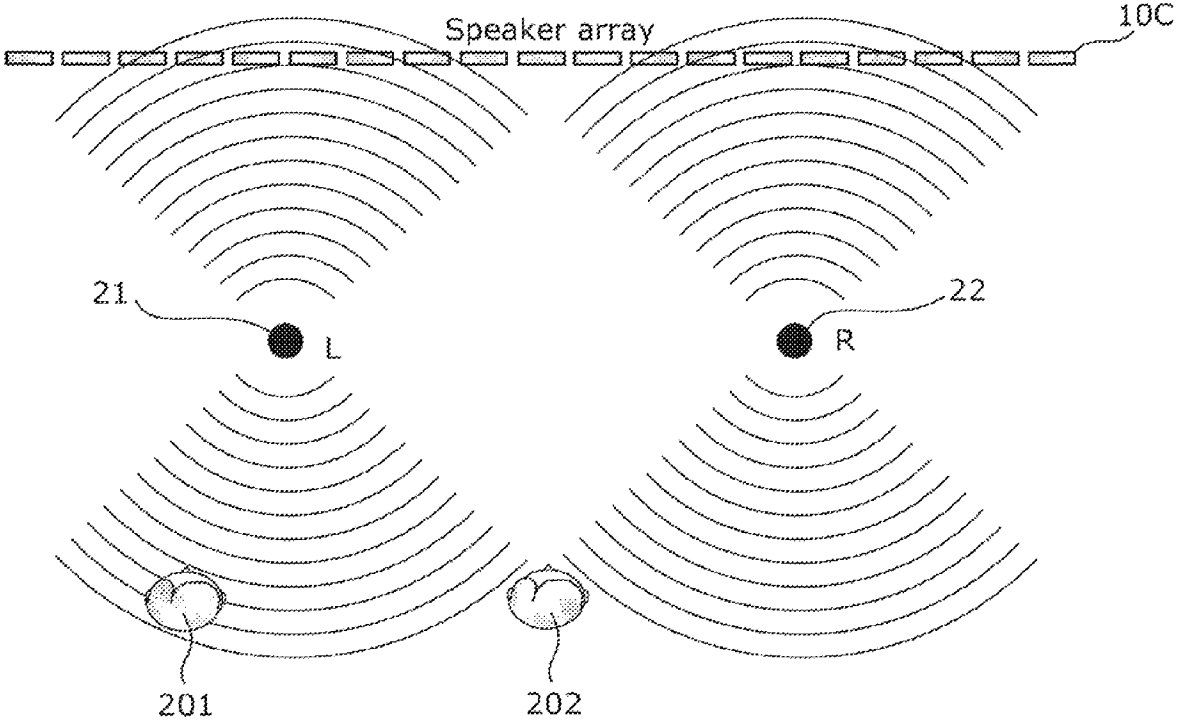
FIG. 2 shows a situation where a stereo signal is rendered and output according to the beamforming technique.

Firstly, a simple method of reproducing a stereo signal with a speaker array is described. FIG. 2 shows a situation where a stereo signal is rendered and output according to the beamforming technique.

Specifically, FIG. 2 shows a rendering method in which the beamforming method is implemented to use two virtual spots in front of a speaker array 10C as left and right virtual sources (a left virtual source 21 and a right virtual source 22). This way, it is possible to generate a novel aural sensation easily and quickly.

However, even with the stereo signal reproduced as if it is output from the left virtual source 21 and the right virtual source 22 shown in FIG. 2, a listener 201 located off-center would feel the resultant sound narrow and unnatural, which is a problem.

For example, a recorded sound source of typical content such as music data on a compact disc (CD) or the like usually includes direct components and diffuse components. The direct components are components common to the left and right sources, and the diffuse components are components other than the direct components. In this regard, only directional sound can be generated by the beamforming method. Therefore, a listener 202 located at or around the center of the speaker array 10C is able to have a wide and natural aural perception for a stereo sound image while the listener 201 located off-center feels the sound narrow and unnatural, which is a problem.

Figure 3A:
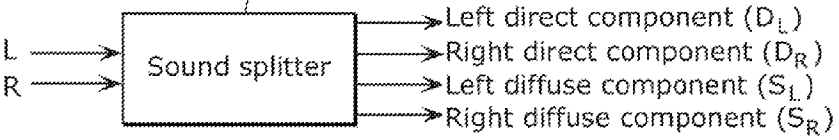
FIG. 3A shows an example of a sound splitter for separating the stereo signal into direct and diffuse components.

Next, a rendering method different from that shown in FIG. 2 is described with reference to FIGS. 3A and 3B. FIG. 3A shows an example of a sound splitter 300 for separating the stereo signal into direct and diffuse components. In addition, FIG. 36 shows a situation where the direct and diffuse components of the stereo signal, obtained by splitting using the sound splitter 300 shown in FIG. 3A, are rendered and output. It is to be noted that there are many sound separation technologies for splitting a sound source into direct and diffuse components, but detailed description of these technologies are out of the scope of the disclosure for the present invention and therefore explanations thereof are omitted.

The direct components (a left direct component ($D_L$) and a right direct component ($D_R$)) of the stereo signal, obtained by splitting using the sound splitter 300 shown in FIG. 3A, are beamformed to two virtual spots, i.e., left and right virtual sources (a left virtual source 31 and a right virtual source 32). The diffuse components (a left diffuse component ($S_L$) and a right diffuse component ($S_R$)) of the stereo signal, obtained by splitting using the sound splitter 300 shown in FIG. 3A, are rendered as plane waves. Here, the diffuse components (the left diffuse component ($S_L$) and the right diffuse component ($S_R$)) are relatively more omni-directional than the beamformed left and right virtual sources (the left virtual source 31 and the right virtual source 32).

The rendering method as above allows a more natural and wider aural perception to be generated to a listener 301.

Here, a psychoacoustic viewpoint is described. In the case where acoustic signals (audio) reaching both ears of a listener are uncorrelated and give reverberation or a sense of separation, the listener perceives the acoustic signals (audio) as a wide stereo sound image.

In other words, the wideness for stereo sound image can also be improved through the implementation of reverberation onto the stereo signal. Reverberation creates the illusion of distance, which helps to move the stereo sources further away from the listener, for example. This creates wider stereo separation, with the result that the listener will perceive a wider stereo sound image. Furthermore, reverberation enhances the sense of envelopment. It is to be noted that reverberation is realized as a result of uncorrelated signals with various kinds of delay given thereto reaching both ears of a listener.

The stereo sound image widening technology based on reverberation is disclosed in the above-stated PTLs 1 to 7. As disclosed in the above-stated PTLs 1 to 7, the stereo sound image widening technology based on reverberation includes, other than the above-described technologies, technologies which involve the use of a filter for delay insertion and polarity inversion, signal decorrelation, and crosstalk implementation.

[Math. 1]

$$L'=L-\text{reverb}(R)$$

$$R'=R-\text{reverb}(L) \quad \text{(Expression 1)}$$

Here, in Expression 1, L and R represent an original stereo signal, L' and R' represent an enhanced stereo signal, and reverb( ) represents a reverberator.

Furthermore, a technology called head shadow modeling is known which has improved the above-stated stereo sound image widening technology. The shadow modeling technology is a technology used to simulate 3D sound sources, which is, as disclosed in the above-stated PTLs 8 to 10, combined with reverberation and has improved the stereo sound image widening technology. Specifically, the head shadow modeling technology is a technology to further increase the illusion of the distance created by a reverberator by moving stereo sound sources away from a listener through delay implementation in both ears of the listener.

In addition, there is another stereo sound image widening technology in which, with the aim of generating a stereo sensation through multi-path reflections, multiple wavefronts at different orientations from one another are generated so that a stereo sensation is generated through multi-path reflections.

However, the above-stated conventional technologies have a problem that the effect of the stereo sound image (the stereo sensation) depends on the position of a listener. This is described below.

Figure 3B:
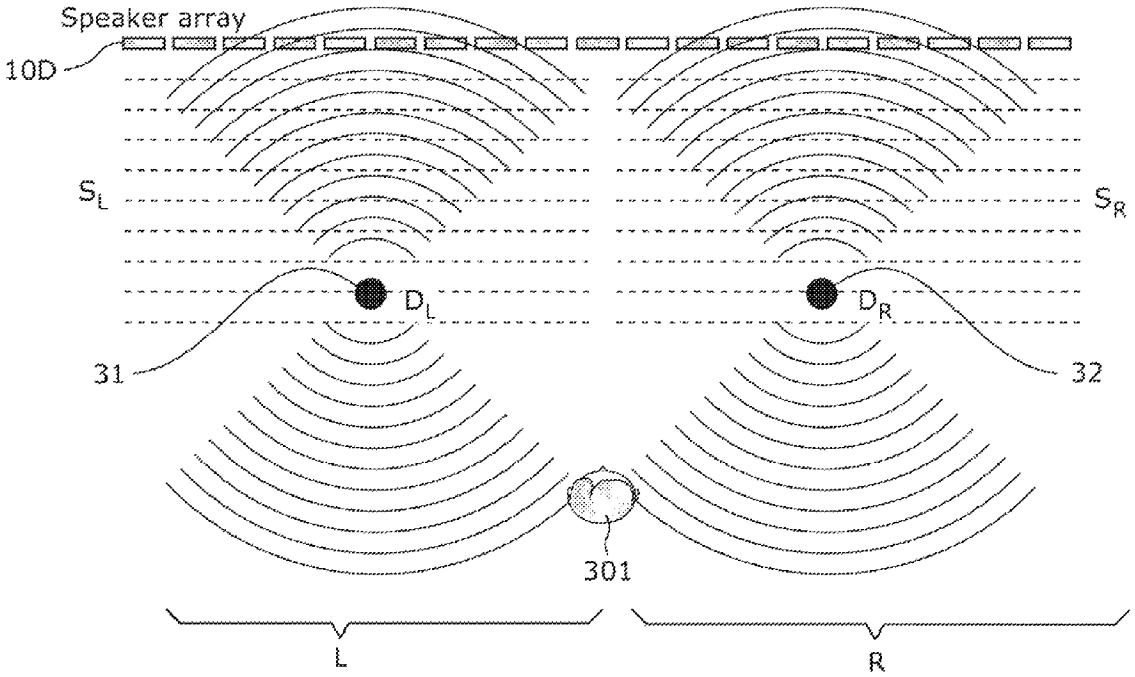
FIG. 3B shows a situation where the direct and diffuse components of the stereo signal, obtained by splitting using the sound splitter shown in FIG. 3A, are rendered and output.
Figure 4:
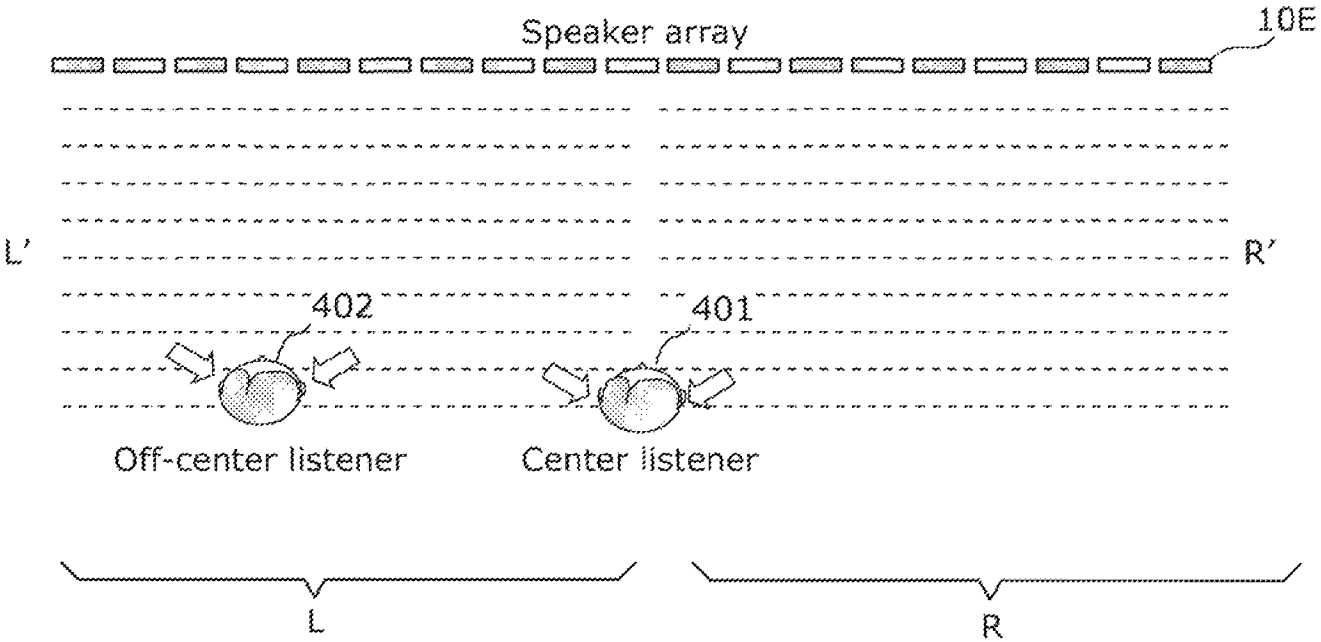
FIG. 4 is an illustration for explaining a problem of the rendering method shown in FIG. 38.

For example, in the rendering method shown in FIG. 3B, a wider aural image is generated, but the stereo sound image (the stereo sensation) is still narrow, when compared with the rendering method shown in FIG. 2. This is described with reference to FIG. 4. FIG. 4 is an illustration for explaining a problem of the rendering method shown in FIG. 3B.

As shown in FIG. 4, a listener 401 located at or around the center of a speaker array 10E can perceive different audio signals in both ears and can therefore perceive a good stereo sound image (stereo sensation). On the other hand, a listener 402 located off-center perceives practically the same sound in both ears, which causes a loss of the stereo sound image (the stereo sensation), and therefore is not able to sufficiently perceive the stereo sound image (the stereo sensation).

It is to be noted that there is also a problem that the stereo sound image widening technology based on reverberation and the improved stereo sound image widening technology based on reverberation which uses the head shadow modeling are not applicable to a speaker array. This is because a speaker array is intended to make sound be listened to at a narrow sweet spot.

However, when an audio signal has been able to be preprocessed with a reverberator, the listener 401 located at or around the center of the speaker array 10E can perceive a wider stereo sound image than in the rendering method shown in FIG. 3B.

However, the listener 402 located off-center listens to the same or like sound images in both ears, which causes a loss of the stereo sound image (the stereo sensation), and therefore is not able to sufficiently perceive the stereo sound image (the stereo sensation), which remains problematic.

As another method for widening a stereo sound image, there is a method in which multiple wavefronts are generated through reflection. However, this method assumes the presence of acoustic reflectors in the surround and therefore is not a guaranteed method.

Thus, an aspect of the present invention has been devised in view of such problems and aims to provide an audio rendering device and an audio rendering method that can provide a wide stereo sound image irrespective of the position of a listener.

In order to achieve the above-stated goal, an audio rendering device according to an aspect of the present invention is an audio rendering device which uses multichannel speakers and comprises: a first delay computation unit configured to compute, based on rendering information about the multichannel speakers, a first delay corresponding to a primary wavefront which propagates in a predetermined traveling direction from a sound source that is each of speakers included in the multichannel speakers; a second delay computation unit configured to compute, based on the rendering information about the multichannel speakers, a second delay corresponding to a secondary wavefront which is generated by the primary wavefront and has a scattering wavefront; an addition unit configured to add up the first delay and the second delay to compute a total delay; and a delay filter which applies the total delay to an input audio signal to generate a multichannel audio signal for use in rendering with the multichannel speakers, and outputs the multichannel audio signal to the multichannel speakers.

With this structure, it is possible to provide a stereo sensation irrespective of the position of a listener.

Furthermore, generating (rendering) a multichannel audio signal from an input audio signal as above allows for the improvement not only in the stereo sensation but also in the sense of envelopment which is given to a listener when the signal is reproduced by multichannel speakers.

Furthermore, for example, the first delay computation unit may be configured to compute the first delay to render the first wavefront in a plane wave or a circular wave.

Furthermore, for example, it may be that the input audio signal is a stereo signal, and the first delay computation unit is configured to compute the first delay to cause the primary wavefront to propagate in different traveling directions between two channel signals in the stereo signal.

Furthermore for example, the second delay computation unit may be configured to compute the second delay using a random value.

Furthermore, for example, the multichannel speakers may be included in a speaker array.

Furthermore, for example, the second delay computation unit may be configured to compute the second delay using a result obtained by (i) squaring an arrangement index of each of speakers included in the speaker array and (ii) computing a modulus of the squared arrangement index with respect to a prime number, the arrangement index indicating a place of the speaker when counted from one end of the speaker array.

Furthermore, for example, the multichannel speakers may be included in a speaker matrix.

Furthermore, for example, the second delay computation unit may be configured to compute the second delay using a result obtained by (i) computing a product of arrangement row and column indices of a speaker among speakers arranged in rows and columns in the speaker matrix and (ii) computing a modulus of the computed product with respect to a prime number.

Furthermore, for example, the rendering information may include spacing from one of the speakers to another.

Furthermore, for example, the rendering information may include a total number of the speakers.

Furthermore, in order to solve the above-stated problems, an audio rendering device according to an aspect of the present invention may be an audio rendering device which uses multichannel speakers and comprises: a sound splitter which separates an input audio signal into direct and diffuse components; a direct component rendering unit configured to render the direct components to generate direct components for use in rendering with multichannel speakers; a first delay computation unit configured to compute, based on rendering information about the multichannel speakers, a first delay corresponding to a primary wavefront which propagates in a predetermined traveling direction from a sound source that is each of speakers included in the multichannel speakers; a second delay computation unit configured to compute, based on the rendering information about the multichannel speakers, a second delay corresponding to a secondary wavefront which is generated by the primary wavefront and synthesized into a scattering wavefront; a first addition unit configured to add up the first delay and the second delay to compute a total delay; a delay filter which applies the total delay to the diffuse components; and a second addition unit configured to add up output from the direct component rendering unit and output from the delay filter, to generate a multichannel signal for use in rendering with the multichannel speakers, and output the multichannel signal to the multichannel speakers.

It is to be noted that these generic or specific aspects may be implemented using a system, a method, an integrated circuit, a computer program, or a computer-readable recording medium such as a compact disc read only memory (CD-ROM), and may also be implemented by any combination of systems, methods, integrated circuits, computer programs, and recording media.

The audio rendering device and the audio rendering method according to an aspect of the present invention is specifically described below with reference to the drawings.

It is to be noted that each of the embodiments described below shows a specific example of the present invention. The numeral values, shapes, materials, structural elements, the arrangement and connection of the structural elements, steps, the processing order of the steps, etc. shown in the following embodiments are mere examples, and therefore do not limit the present invention. Therefore, among the structural elements in the following embodiments, structural elements not recited in any one of the independent claims defining the broadest concept are described as arbitrary structural elements.

(Embodiment 1)

Figure 5:
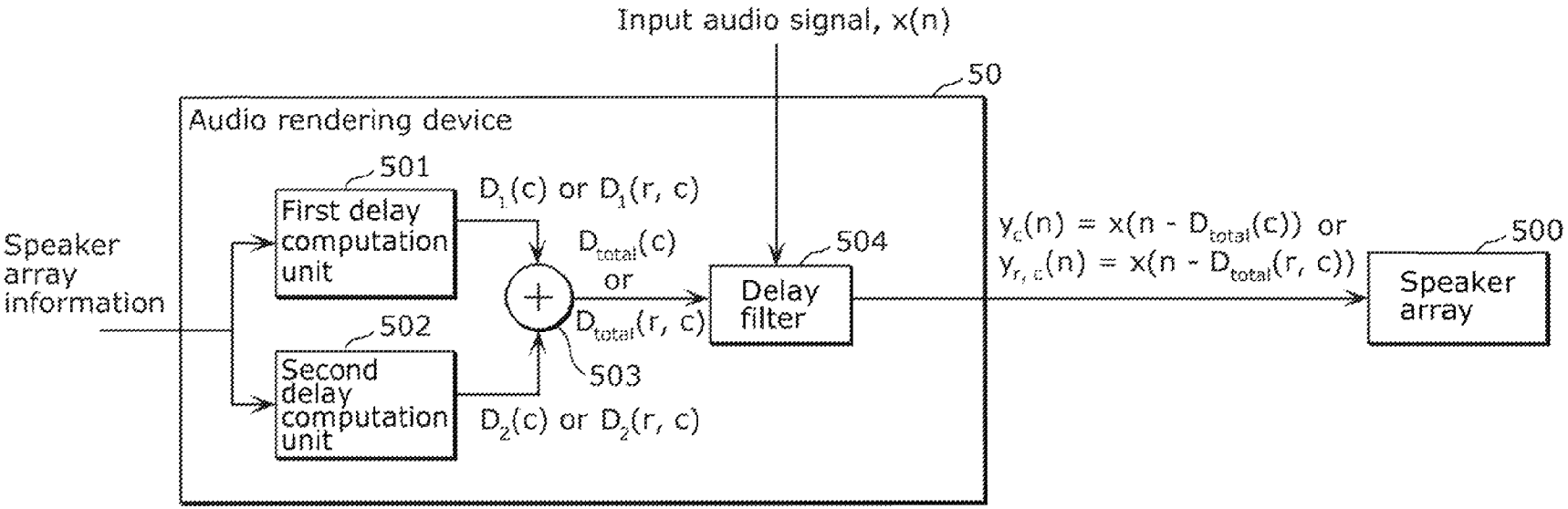
FIG. 5 is a block diagram showing a structure of an audio rendering device according to Embodiment 1.
Figure 6A:
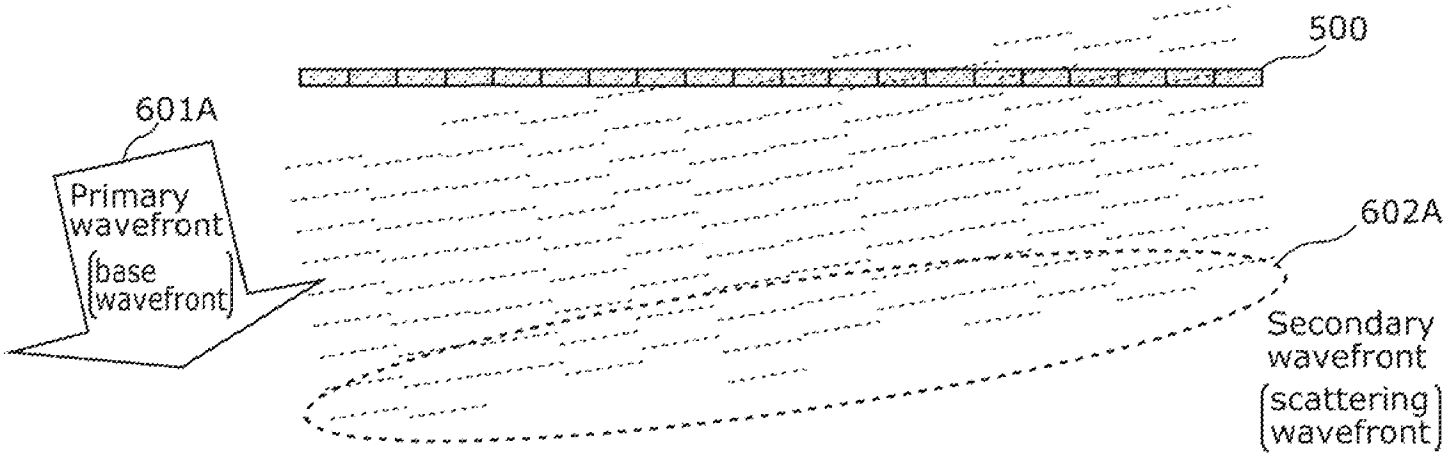
FIG. 6A is an illustration for explaining an effect of the stereo signal rendered using the audio rendering device according to Embodiment 1, of when the stereo signal is output from a speaker array.
Figure 6B:
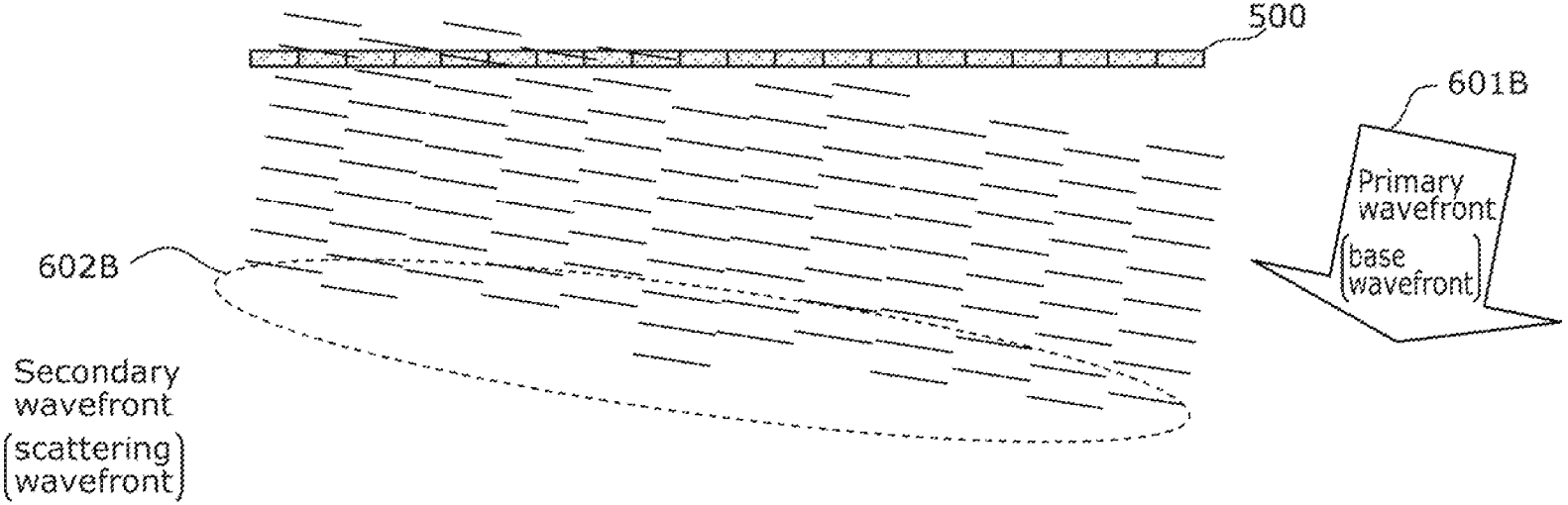
FIG. 6B is an illustration for explaining an effect of the stereo signal rendered using the audio rendering device according to Embodiment 1, of when the stereo signal is output from the speaker array.
Figure 7A:
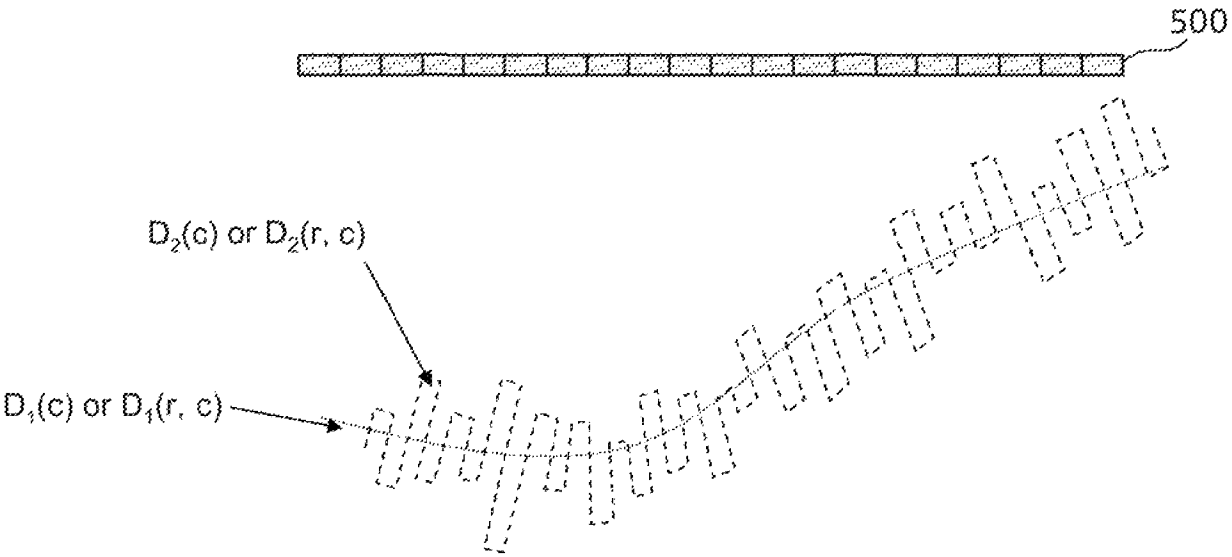
FIG. 7A is an illustration showing an effect of the stereo signal rendered using the audio rendering device according to Embodiment 1, of when the stereo signal is output from the speaker array.
Figure 7B:
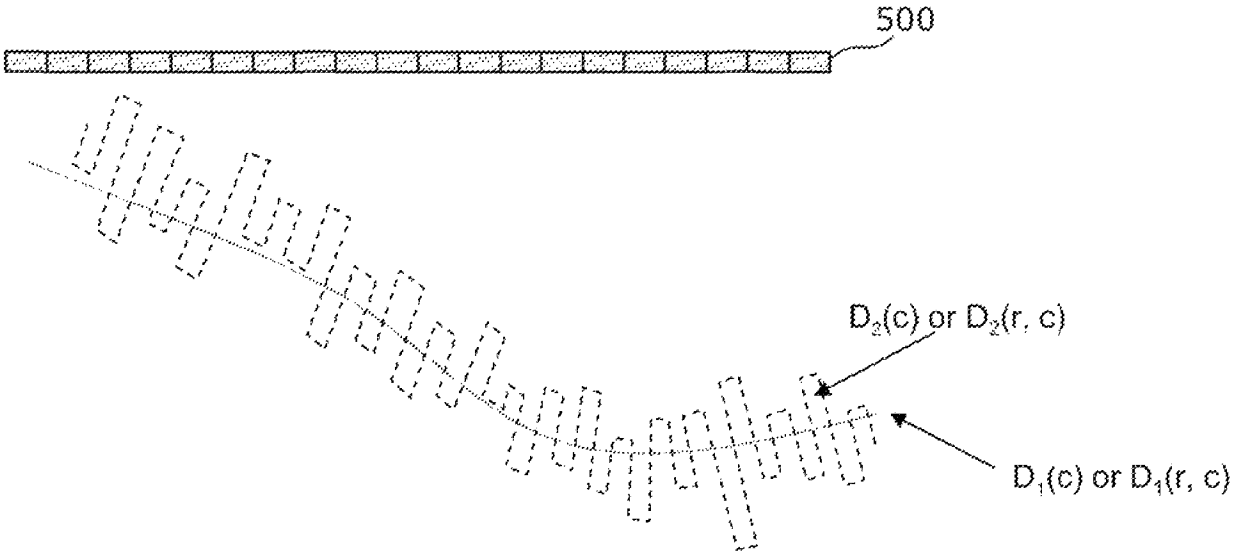
FIG. 7B is an illustration showing an effect of the stereo signal rendered using the audio rendering device according to Embodiment 1, of when the stereo signal is output from the speaker array.
Figure 8:
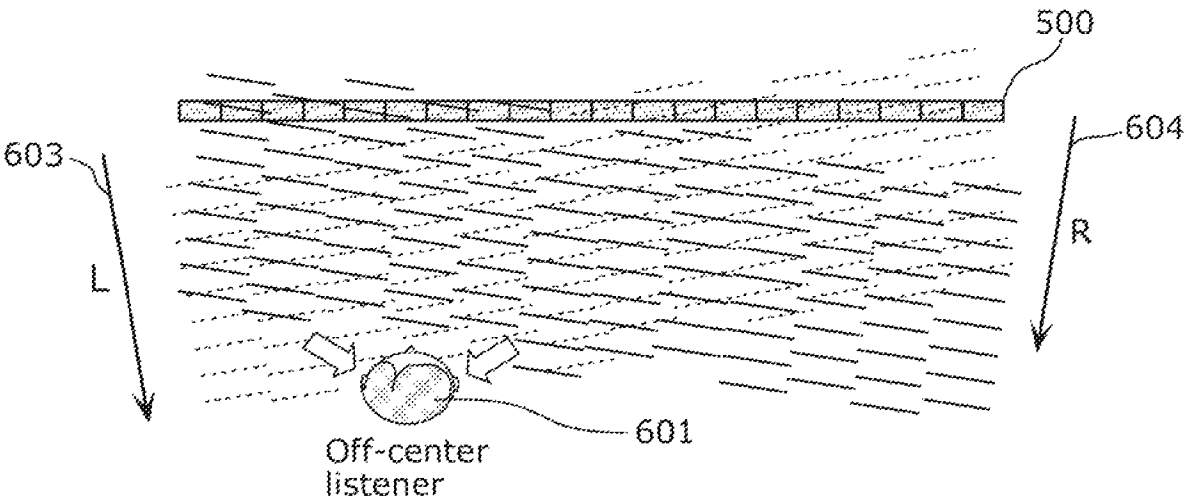
FIG. 8 shows a situation where the stereo signal rendered using the audio rendering device according to Embodiment 1 is reproduced by the speaker array.

FIG. 5 is a block diagram showing a structure of an audio rendering device according to Embodiment 1. FIGS. 6A and 6B are each an illustration for explaining an effect of a stereo signal rendered using the audio rendering device according to Embodiment 1, of when the stereo signal is output from a speaker array. FIGS. 7A and 7B are each an illustration showing an effect of the stereo signal rendered using the audio rendering device according to Embodiment 1, of when the stereo signal is output from the speaker array. FIG. 8 shows a situation where the stereo signal rendered using the audio rendering device shown in FIG. 5 is reproduced by the speaker array.

An audio rendering device 50 shown in FIG. 5 is an audio rendering device using a speaker array 500 and includes a first delay computation unit 501, a second delay computation unit 502, an adder 503, and a delay filter 504.

It is to be noted that the speaker array 500 is an example of the multichannel speakers, for example. As mentioned above, the multiple speakers are not limited to a speaker array and may be a speaker matrix. In other words, the speaker array 500 is merely shown as an example in FIG. 5.

The first delay computation unit 501 computes, based on information on the arrangement of the speaker array 500 (speaker array information), first delays corresponding to a primary wavefront that propagates in a predetermined traveling direction from a sound source that is each of the plural speakers included in the speaker array 500.

Specifically, the first delay computation unit 501 computes delays (first delays) that produce (lead to wave field synthesis to generate) a primary wavefront (a base wavefront) which propagates in a predetermined traveling direction just as a primary wavefront 601A (a base wavefront) shown in FIG. 6A and a primary wavefront 601B shown in FIG. 6B.

In more detail, the first delay computation unit 501 computes a first delay $D_1(c)$ for the $c^{th}$ speaker among the plural speakers included in the speaker array 500. Here, the $c^{th}$ place represents an ordinal number of a speaker among the plural speakers in the speaker array 500 counted from one end of the speaker array 500. It is to be noted that, in the case where the multichannel speakers are a speaker matrix including R rows and C columns of speakers instead of the speaker array 500, the first delay computation unit 501 computes a first delay $D_1(r, c)$ for the speaker at the $r^{th}$ row and the $c^{th}$ column.

Here, the first delay computation unit 501 computes the first delays so that the primary wavefront (the base wavefront) becomes a plane wave or a circular wave, for example.

In more detail, in the case where the multichannel speakers are the speaker array 500, the first delay computation unit 501 computes the first delay $D_1(c)$ using Expression 2, for example, to emit a plane wave from the $c^{th}$ speaker in the speaker array 500.

[Math. 2]

$$D_1(c)=\alpha\cdot c+\beta \quad \text{(Expression 2)}$$

Here, α and β are predetermined values. The same applies to the following cases.

Likewise, in the case where the multichannel speakers are a speaker matrix, the first delay computation unit 501 computes the first delay $D_1(r, c)$ using Expression 3, for example, to emit a plane wave from the speaker at the $R^{th}$ row and the $C^{th}$ column in the speaker matrix.

[Math. 3]

$$D_1(r,c)=\alpha\cdot c+\beta\cdot r+\gamma \quad \text{(Expression 3)}$$

Here, not only α and β, but also γ are predetermined values.

Furthermore, in the case where the multichannel speakers are the speaker array 500, the first delay computation unit 501 computes the first delay $D_1(c)$ using Expression 4, for example, to emit a circular wave from the $c^{th}$ speaker in the speaker array 500.

[Math. 4]

$$D_1(c)=\gamma\sqrt{(c-\alpha)^2+\beta} \quad \text{(Expression 4)}$$

Here, as mentioned above, α and β are predetermined values.

Likewise, in the case where the above multichannel speakers are a speaker matrix, the first delay computation unit 501 computes the first delay using Expression 5, for example, to emit a circular wave from the speaker at the $R^{th}$ row and the $C^{th}$ column in the speaker matrix.

[Math. 5]

$$D_1(r,c)=\gamma\sqrt{(c-\alpha)^2+(r-\delta)^2+\beta} \quad \text{(Expression 5)}$$

Here, not only α and β, but also δ and γ are predetermined values.

The second delay computation unit 502 computes, based on the information on the arrangement of the speaker array 500 (the speaker array information), second delays corresponding to a secondary wavefront which is generated by the propagating primary wavefront and has a scattering wavefront.

Specifically, the second delay computation unit 502 computes delays (the second delays) that produce a secondary wavefront having a scattering wavefront just as a secondary wavefront 602A shown in FIG. 6A and a second wavefront 602B shown in FIG. 66.

In more detail, the second delay computation unit 502 computes a second delay $D_2(c)$ for the $c^{th}$ speaker in the speaker array 500.

It is to be noted that, in the case where the above multichannel speakers are a speaker matrix including R rows and C columns of speakers instead of the speaker array 500, the second delay computation unit 502 computes a second delay $D_2(r, c)$ for the speaker at the $r^{th}$ row and the $c^{th}$ column.

Here, the second delay computation unit 502 computes the second delays using random values to mimic an uneven surface of the scattering wavefront. A method of computing the second delays using the random values is described below.

In the case where the above multichannel speakers are the speaker array 500, the second delay computation unit 502 computes the second delay $D_2(c)$ using Expression 6, for example, to produce the scattering wavefront subjected to the wave field synthesis using the $c^{th}$ speaker in the speaker array 500 as a sound source.

[Math. 6]

$$D_2(c)=\alpha\cdot\text{rand}(\ )+\beta \quad \text{(Expression 6)}$$

Here, rand( ) is a random value generator, and α and β are predetermined values.

Likewise, in the case where the multichannel speakers are a speaker matrix, the second delay computation unit 502 computes the second delay $D_2(c)$ using Expression 7, for example, to produce the scattering wavefront subjected to the wave field synthesis using, as a sound source, the speaker at the $R^{th}$ row and the $C^{th}$ column in the speaker matrix.

[Math. 7]

$$D_2(r,c)=\alpha\cdot\text{rand}(\ )+\beta \quad \text{(Expression 7)}$$

Here, rand( ) is a random value generator, and α and β are predetermined values, as in the above case.

It is to be noted that the method of computing the second delays that produce the secondary wavefront that is the scattering wavefront by using the second delay computation unit 502 is not limited to the above case using the random values. For example, the second delay computation unit 502 may compute the second delays using a Schroeder diffuser for mimicking an uneven surface of the scattering wavefront. This method is described below.

The Schroeder diffuser is a physical diffuser containing multiple wells with different "depth factors" designed to scatter an incident wave into multiple reflected wavelets. It is known that the use of the Schroeder diffuser in acoustic treatment allows sound to be diffused uniformly in all directions. Therefore, it is often used in the acoustic treatment to produce aurally pleasant sound.

Figure 9A:
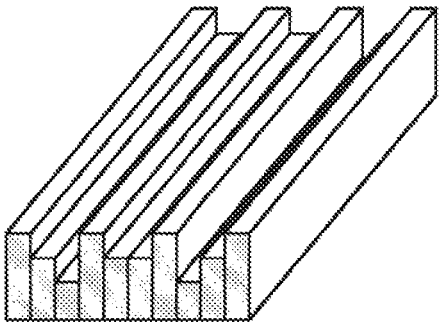
FIG. 9A is an external view of an acoustic panel with a Schroeder diffuser.
Figure 9B:
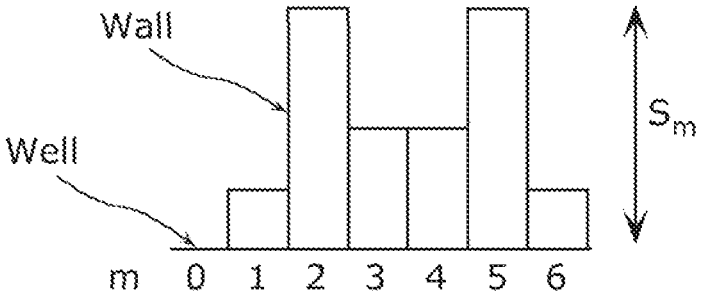
FIG. 9B shows depth factors for defining a wall and a well of the Schroeder diffuser.

FIG. 9A is an external view of an acoustic panel with the Schroeder diffuser, and FIG. 9B shows depth factors for defining a wall and a well of the Schroeder diffuser.

A depth factor $S_m$ of a well of the Schroeder diffuser can be computed as a quadratic residue sequence by Expression 8,

[Math. 8]

$$S_m=m^2 \bmod p \quad \text{(Expression 8)}$$

Here, m is a sequential positive integer number 0, 1, 2, 3, 4, etc., and p is a prime number. And mod represents the modulo operation.

One way to compute the second delays using the Schroeder diffuser to mimic an uneven surface of the scattering wavefront is to set the second delays to be proportional to the depth factor $S_m$ of the Schroeder diffuser. For example, an arrangement index c of the $c^{th}$ speaker among the plural speakers included in the speaker array 500 can be replaced by the above positive integer m to set the second delay.

Specifically, in the case where the multichannel speakers are the speaker array 500, the second delay computation unit 502 is capable of computing, using Expression 9, the second delay $D_2(c)$ for the $c^{th}$ speaker (with the arrangement index c) in the speaker array 500.

[Math. 9]

$$D_2(c)=\alpha\cdot S_c+\beta \quad \text{(Expression 9)}$$

Here, α and β are predetermined values.

Likewise, in the case where the multichannel speakers are a speaker matrix, the second delay computation unit 502 is capable of computing the second delay $D_2(r, c)$ for the speaker at the $R^{th}$ row and the $C^{th}$ column using $S_{r,c}$ that is the depth factor of a well indicated in Expression 10, and Expression 11.

[Math. 10]

$$S_{r,c}=(r\cdot c)\bmod p \quad \text{(Expression 10)}$$

[Math. 11]

$$D_2(r,c)=\alpha\cdot S_{r,c}+\beta \quad \text{(Expression 11)}$$

Here, as mentioned above, α and β are predetermined values.

It is to be noted that each of the first delay computation unit 501 and the second delay computation unit 502 requires the speaker array information including the geometric layout, such as the number, spacing, etc., of speakers included in the speaker array, the directivity pattern, and so on, that is, the rendering information about the multichannel speakers (the speaker array or matrix).

The adder 503 is an example of the addition unit or the first addition unit and computes a total delay by adding up the first delays and the second delays.

Specifically, the adder 503 adds up, as indicated in Expression 12, the first delay $D_1(c)$ computed by the first delay computation unit 501 and the second delay $D_2(c)$ computed by the second delay computation unit 502, to compute a total delay $D_{total}(c)$ for the $c^{th}$ speaker in the speaker array 500.

[Math. 12]

$$D_{total}(c)=D_1(c)+D_2(c) \quad \text{(Expression 12)}$$

It is to be noted that, in the case where the multichannel speakers are a speaker matrix including R rows and C columns of speakers instead of the speaker array 500, the adder 503 adds, as indicated in Expression 13, the first delay $D_1(r, c)$ computed by the first delay computation unit 501 and the second delay $D_2(r, c)$ computed by the second delay computation unit 502, to compute a total delay $D_{total}(r, c)$ for the $c^{th}$ speaker at the $r^{th}$ row and the $c^{th}$ column.

[Math. 13]

$$D_{total}(r,c)=D_1(r,c)+D_2(r,c) \quad \text{(Expression 13)}$$

The delay filter 504 applies, to an input audio signal, the total delay computed by the adder 503, to generate a multichannel audio signal for use in the rendering with the speaker array 500, and outputs the multichannel audio signal to the speaker array 500.

Specifically, the delay filter 504 is an integer delay filter, for example, and applies, as indicated in Expression 14, the total delay $D_{total}(c)$ computed by the adder 503, to an input audio signal x(n), to produce a multichannel signal $y_c(n)$ for rendering for the $c^{th}$ speaker. Here, n is a sample index.

[Math. 14]

$$y_c(n)=x(n-D_{total}(c)) \quad \text{(Expression 14)}$$

It is to be noted that, in the case where the multichannel speakers are a speaker matrix including R rows and C columns of speakers instead of the speaker array 500, the delay filter 504 applies, as indicated in Expression 15, the total delay $D_{total}(r, c)$ computed by the adder 503, to an input audio signal x(n), to produce a multichannel signal $y_{r,c}(n)$ for rendering.

[Math. 15]

$$y_{r,c}(n)=x(n-D_{total}(r,c)) \quad \text{(Expression 15)}$$

The stereo signal (the multichannel signal) rendered using the audio rendering device 50 structured as above is output to the speaker array 500. With this, each speaker (a sound source) of the speaker array 500 is capable of reproducing the audio signal (the multichannel signal) in which the primary wavefront and the scattering wavefront (the secondary wavefront) are combined as shown in FIG. 7A or 7B.

An effect of the stereo signal rendered using the audio rendering device 50 of when the stereo signal is reproduced by the speaker array 500 is specifically described below with reference to FIGS. 6A, 6B, and 8. It is to be noted that the input audio signal is described as the stereo signal below.

Firstly, the speaker array 500 reproduces the stereo signal (left and right signals) by generating (performing the wave field synthesis of) the primary wavefront 601A and the primary wavefront 601B which are oriented in predetermined directions as shown in FIGS. 6A and 6B. Specifically, the speaker array 500 reproduces a left signal subjected to the wave field synthesis such that the primary wavefront 601A is steered slightly toward the right as shown in FIG. 6A, for example. Furthermore, the speaker array 500 reproduces a right signal subjected to the wave field synthesis such that the primary wavefront 601B is steered slightly toward the left as shown in FIG. 6B, for example.

Such a primary wavefront (a base wavefront) is generated as described above by applying the first delay computed as appropriate for each speaker (each channel) included in the speaker array 500, to the input audio signal so that the first delay is assigned to the corresponding speaker (the corresponding channel).

This enables even a listener 601 located further away from the center (the sweet spot) of the speaker array 500 to perceive bath the left and right signals, that is, to perceive a stereo sensation, as shown in FIG. 8.

Furthermore, the speaker array 500 reproduces the stereo signal in a way such as to synthesize the scattering wavefront as the secondary wavefront. Specifically, the speaker array 500 reproduces the left signal subjected to the wave field synthesis such that the second wavefront 602A as shown in FIG. 6A becomes a scattering wavefront, and reproduces the right signal subjected to the wave field synthesis such that the secondary wavefront 602B as shown in FIG. 66 becomes a scattering wavefront.

Such a secondary wavefront (a scattering wavefront) is generated by application of the second delay accordingly computed as described above, to the input audio signal assigned to each channel.

As a result, a large amount of sound reproduced from the left and right signals which are densely packed and have been delayed reach both ears of the listener 601. When such sound reaches both ears, the listener will be given a pleasant stereo sensation, a reverberation sensation, and so on.

For example, as a result of the second delays being computed using the random values, the listener 601 can perceive a large amount of sound which is densely packed and akin to reverberation. This means that it is possible to improve a sense of presence given to the listener 601 irrespective of the position of the listener. Furthermore, it is possible to realize more uniform sound diffusion to the listener 601 by computing the second delays using the mathematical property of the Schroeder diffuser, for example. This means that it is possible to provide a stereo sound image with a wideness sensation to the listener 601 irrespective of the position of the listener.

Thus, the audio rendering device 50 is capable of generating multichannel audio signals rendered on the first wavefront which propagates in a predetermined traveling direction determined by the first delays and on the second wavefront that becomes a scattering wavefront containing a large number of densely packed and delayed audio signals due to the second delays. This allows the multichannel speakers to reproduce, using the generated multichannel audio signals, audio signals which give a higher stereo sensation to a listener. Furthermore, it is possible to also give an enhanced sense of envelopment.

It is to be noted that the primary wavefront and the secondary wavefront (the scattering wavefront) may be dynamically varied over time. In this case, smoothing may be applied to either the delay values or the multichannel audio signals to enable a smooth transition from one wavefront to another.

Furthermore, the above-stated expressions can be generalized without deviating from the spirit of the present invention and therefore, a speaker included in the multichannel speakers may be placed in a stationary or movable state on a flat or three-dimensional (3D) surface, for example.

In the above-stated expressions, the constants may be zero. In this case, a plane wave parallel to the speaker array 500 is generated. Since the same or like effect is produced when the input audio signal is monaural, this case is also included in the spirit of the present invention.

Furthermore, the foregoing describes that generating the primary wavefront that guides sound propagation so as to emit a plane wave or a circular wave enables the audio signals to be also guided toward an off-center listener located away from the center of the multichannel speakers, which is not the only example. A combination with another uncorrelated audio signal rendered is also possible to create a stereo sensation which does not depend on positions.

It is to be noted that this embodiment may not only be implemented as a device, but also be implemented as a method which includes, as steps, processing units included in the device. This is briefly described below.

Figure 10:
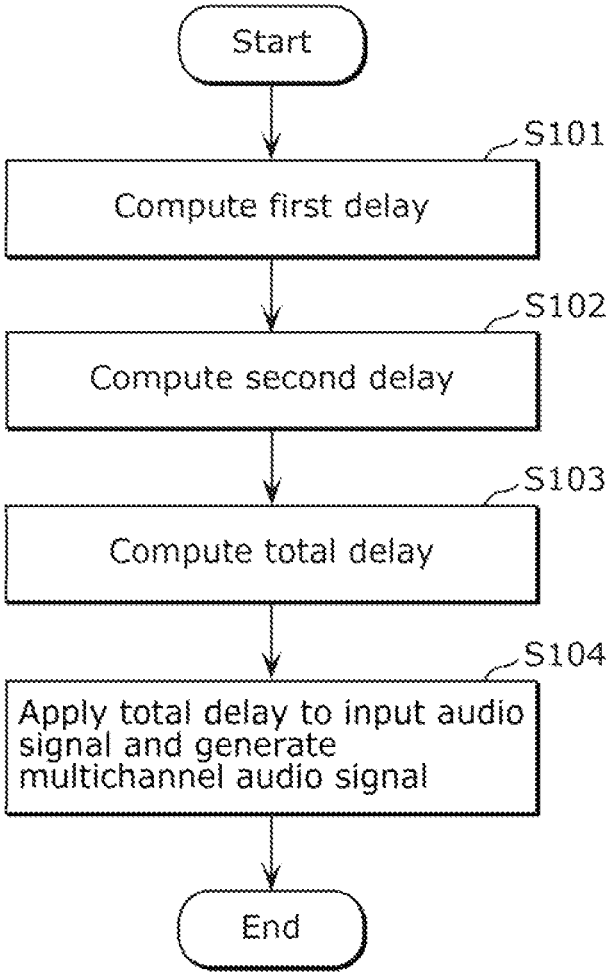
FIG. 10 is a flowchart showing a process in an audio rendering method according to Embodiment 1.

FIG. 10 is a flowchart showing a process in an audio rendering method according to Embodiment 1.

The audio rendering device 50 according to this embodiment firstly computes, based on rendering information about multichannel speakers, a first delay corresponding to a primary wavefront which propagates in a predetermined traveling direction from a sound source that is each of the plural speakers included in the multichannel speakers (S101).

For example, the first delay is computed which corresponds to the primary wavefront for propagating each of the left and right signals in the stereo signal in a predetermined direction. Specifically, a first delay for each channel (each speaker) of the speaker array or the speaker matrix is computed, and the computed first delay is implemented (reproduced) by a corresponding channel (a corresponding speaker), with the result that the above primary wavefront can be generated.

Next, based on the rendering information about the multichannel speakers, a second delay is computed which corresponds to a secondary wavefront which is generated by the propagating primary wavefront and has a scattering wavefront (S102).

For example, the second delay computed in S102 is applied to the input audio signal assigned to each channel (each speaker) of the speaker array or the speaker matrix, with the result that the second wavefront that becomes a scattering wavefront can be generated.

Next, the computed first delay and second delay are added to compute a total delay (S103).

Next, the total delay is applied to the input audio signal to generate a multichannel audio signal for use in the rendering with the multichannel speakers (S104). The generated multichannel audio signal is then output to the multichannel speakers.

The above method can enhance the stereo sensation and sense of envelopment given by the reproduced audio signals and therefore allows a listener to perceive the sensation of diffusion and reverberation as well, irrespective of his or her position.

(Embodiment 2)

In Embodiment 2, a description is given to the case where an input sound source is separated into direct and diffuse components, which is applied to the audio rendering device in Embodiment 1.

Figure 11:
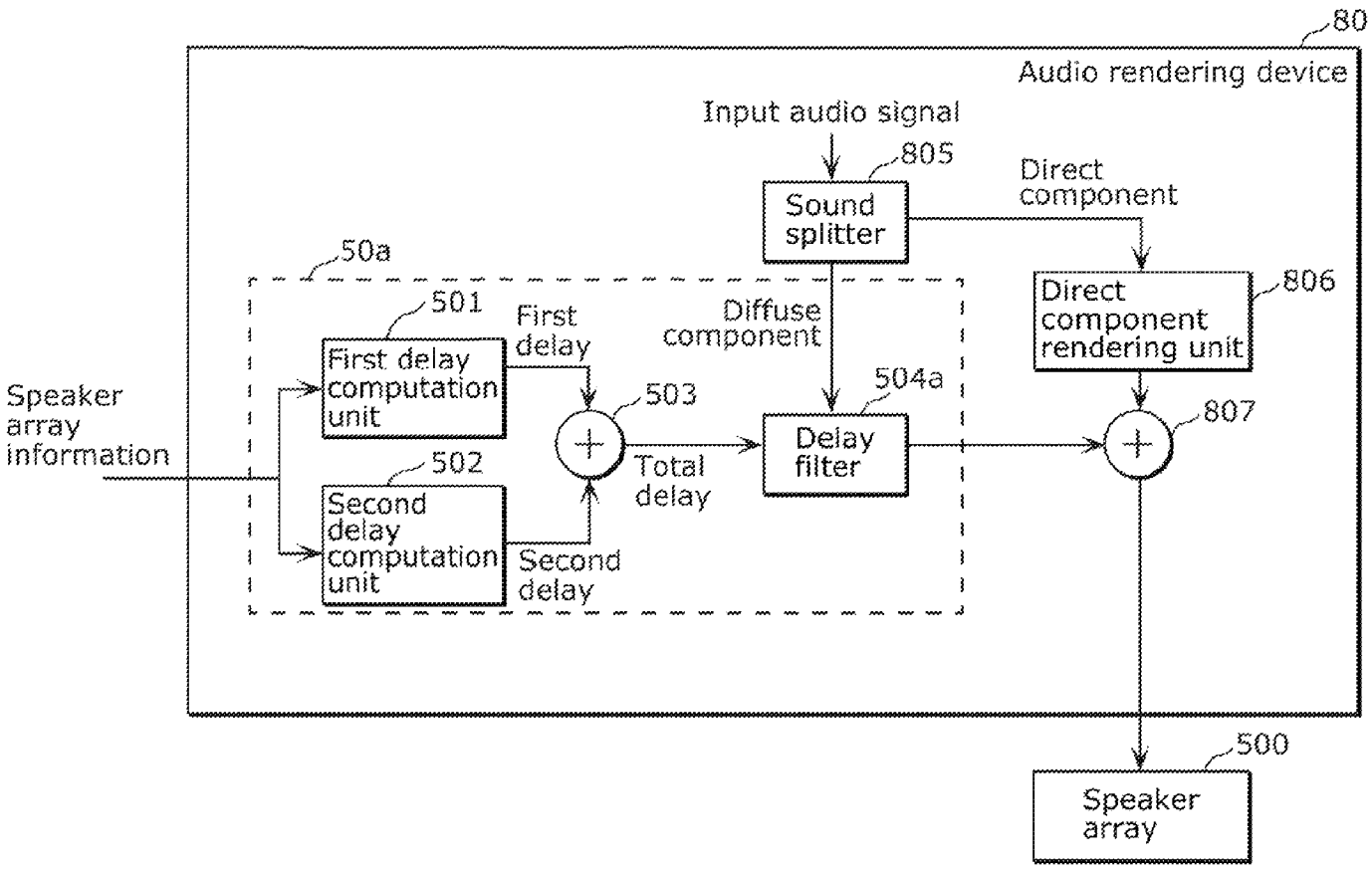
FIG. 11 is a block diagram showing a structure of an audio rendering device according to Embodiment 2.

FIG. 11 is a block diagram showing a structure of an audio rendering device according to Embodiment 2.

An audio rendering device 80 shown in FIG. 11 has a structure including, in addition to an audio rendering device 50*a* corresponding to Embodiment 1, a sound splitter 805, a direct component rendering unit 806, and an adder 807.

The sound splitter 805 separates an input audio signal into direct and diffuse components.

Here, assume in the descriptions below that the input audio signal is a stereo signal.

Firstly, the stereo signal can be modeled as in Expressions 16 and 17, for example.

[Math. 16]

$$L(n)=\alpha\cdot D(n-d)+S_l(n) \quad \text{(Expression 16)}$$

[Math. 17]

$$R(n)=D(n)S_r(n) \quad \text{(Expression 17)}$$

Here, n represents a sample index, L(n) represents a left signal in a stereo signal, and R(n) represents a right signal in the stereo signal. Furthermore, d represents delay, and $\alpha$ represents a gain of a factor for the left stereo input signal. D(n-d) represents a direct component of the left signal in the stereo signal, and D(n) represents a direct component of the right signal in the stereo signal. $S_l(n)$ and $S_r(n)$ represent a diffuse component of the left signal and a diffuse component of the right signal, respectively.

The sound splitter 805 then formulates an error function based on parameters for the stereo signal modeled as above, to solve all the parameters $\alpha$, d, D(n−d), D(n), $S_l(n)$, and $S_r(n)$ simultaneously by minimizing the error function. Thus, the sound splitter 805 is capable of estimating the direct and diffuse components using the solved parameters.

In short, the sound splitter 805 separates the input audio signal into direct and diffuse components by solving the parameters for the above-described modeled stereo signal.

It is to be noted that the method of separating sound by the sound splitter 805 is not limited to the above-described sound separation method. Any method can be applied as long as the sound splitter 805 can generate mutually-uncorrelated diffuse components due to the nature of the input audio signal employed.

Here, an operation of each of the first delay computation unit 501, the second delay computation unit 502, the adder 503, and a delay filter 504*a* is as described in Embodiment 1 and therefore an explanation thereof is omitted. A difference from Embodiment 1 is that the input signal which enters the delay filter 504*a* is a diffuse component of the input audio signal outputted from the sound splitter 805.

This means that the delay filter 504*a* applies the total delay to the diffuse component of the input audio signal outputted from the sound splitter 805.

The direct component rendering unit 806 renders a direct component and generates a direct component for use in the rendering with the multichannel speakers.

In other words, the direct component rendering unit 806 renders a direct component of the input audio signal outputted from the sound splitter 805. It is to be noted that the rendering method can be implemented based on the above-described beamforming or Rayleigh integral and therefore, an explanation thereof is omitted.

The adder 807 is an example of the first addition unit and adds up the output from the direct component rendering unit 806 and the output from the delay filter 504 to generate a multichannel signal for use in the rendering with the multichannel speakers, and then outputs the multichannel signal to the multichannel speakers.

Specifically, the adder 807 adds up the output from the direct component rendering unit 806 and the output from the delay filter 504 to generate the multichannel signal which is to be output to the speaker array 500.

With the audio rendering device 80 configured as above, it is possible to generate the primary wavefront and the scattering wavefront using the mutually-uncorrelated diffuse components, with the result that the stereo sensation and the sense of envelopment can be further enhanced.

It is to be noted that this embodiment teaches how to combine the audio rendering device according to Embodiment 1 with the sound splitter. Specifically, the rendering is applied only to the diffuse components from the sound splitter in this embodiment. Thus, it is possible to generate the mutually-uncorrelated diffuse components by the sound splitter, which produces an effect that the perception of the stereo sound image (the stereo sensation and the sense of envelopment) can be significantly enhanced.

It is to be noted that this embodiment can be applied to an arbitrary number of direct and diffuse components. Specifically, the direct and diffuse components may be extracted from a subset of the multichannel audio signal. For example, for a 5.1 channel source, only the front channels may be processed by the sound splitter 805 to generate the direct and diffuse components.

In addition, as a variation of this embodiment, an input audio signal in which all the direct and diffuse components are pre-processed may be input instead of using the sound splitter 805. Here, applicable examples of the pre-processing are indicated below which are all within the scope of the present invention.

(1) The diffuse components may be pre-processed by reverberation filters, polarity-reversers, etc. The reverberation filters may be different for each channel. This serves to counter comb filter effects at certain listening spots.

(2) Furthermore, spectral regions prone to comb filtering may be adjusted to alleviate comb filter effects.

(3) High frequency boosting may be applied to compensate for more rapid high frequency attenuation versus the distance of propagation when compared with the case of a low frequency.

As above, the present invention can provide the audio rendering device and the audio rendering method that can give a stereo sensation irrespective of the position of a listener. For example, when a speaker array or a speaker matrix reproduces a multichannel audio signal rendered using the audio rendering device and the audio rendering method according to the present invention, it is possible to enhance the stereo sensation and the sense of envelopment, which can give a stereo sensation and a sense of envelopment irrespective of the position of a listener.

It is to be noted that in each of the above embodiments, each structural element may be constituted by dedicated hardware or achieved by executing a software program suited to the structural element. Each structural element may be achieved by a program execution unit such as a CPU or a processor executing a software program recorded on a recording medium such as a hard disk or a semiconductor memory. Here, the software which achieves the audio rendering device according to each of the above embodiments is the following program.

Specifically, this program causes a computer to execute an audio rendering method comprising: computing, based on rendering information about the multichannel speakers, a first delay corresponding to a primary wavefront which propagates in a predetermined traveling direction from a sound source that is each of speakers included in the multichannel speakers; computing, based on the rendering information about the multichannel speakers, a second delay corresponding to a secondary wavefront which is generated by the primary wavefront and synthesized into a scattering wavefront; adding up the first delay and the second delay to compute a total delay; and applying the total delay to an input audio signal to generate a multichannel audio signal for use in rendering with the multichannel speakers, and outputting the multichannel audio signal to the multichannel speakers.

Although the audio rendering device, the audio rendering method, etc., according to one or more aspects of the present invention have been described above based on the embodiments, the present invention is not limited to these embodiments. Various modifications to the present embodiments that can be conceived by those skilled in the art, and forms configured by combining structural elements in different embodiments without departing from the teachings of the present invention may be included in the scope of one or more of the aspects of the present invention.

INDUSTRIAL APPLICABILITY

The present invention is usable in a wide range of applications that employ or equipped with a multichannel speaker array and/or matrix, such as a sound bar, a television (TV), a personal computer (PC), a mobile phone, and a tablet device, with an integrated speaker array and/or matrix, an attachable speaker array and/or matrix accessory, etc.

REFERENCE SIGNS LIST

10A, 10B, 10C, 10D, 500 Speaker array
11 Primary source
12 Virtual source
21, 31 Left virtual source
22, 32 Right virtual source
50, 50*a*, 80 Audio rendering device
201, 202, 301, 401, 402, 601, 602 Listener
300, 805 Sound splitter
501 First delay computation unit
502 Second delay computation unit
503, 807 Adder
504, 504*a* Delay filter
601A, 601B Primary wavefront
602A, 602B Secondary wavefront
806 Direct component rendering unit

The invention claimed is:

1. An audio rendering device which uses multichannel speakers, the device comprising:

a first delay computation unit configured to compute, based on rendering information about the multichannel speakers, a first delay which is assigned to each of speakers included in the multichannel speakers and generates a primary wavefront which propagates in a predetermined traveling direction from a sound source that is each of the speakers;

a second delay computation unit configured to compute, based on the rendering information about the multichannel speakers, a second delay which is assigned to each of the speakers and generates, on the primary wavefront, a secondary wavefront having a scattering wavefront;

an addition unit configured to add up the first delay and the second delay to compute a total delay for each of the speakers; and a delay filter which applies the total delay to an input audio signal to generate a multichannel audio signal for use in rendering with the multichannel speakers, and outputs the multichannel audio signal to the multichannel speakers.

2. The audio rendering device according to claim 1, wherein the first delay computation unit is configured to compute the first delay to render the first wavefront in a plane wave or a circular wave.

3. The audio rendering device according to claim 2, wherein the input audio signal is a stereo signal, and the first delay computation unit is configured to compute the first delay to cause the primary wavefront to propagate in different traveling directions between two channel signals in the stereo signal.

4. The audio rendering device according to claim 1, wherein the second delay computation unit is configured to compute the second delay using a random value.

5. The audio rendering device according to claim 1, wherein the multichannel speakers are included in a speaker array.

6. The audio rendering device according to claim 5, wherein the second delay computation unit is configured to compute the second delay using a result obtained by (i) squaring an arrangement index of each of speakers included in the speaker array and (ii) computing a modulus of the squared arrangement index with respect to a prime number, the arrangement index indicating a place of the speaker when counted from one end of the speaker array.

7. The audio rendering device according to claim 1, wherein the multichannel speakers are included in a speaker matrix.

8. The audio rendering device according to claim 7, wherein the second delay computation unit is configured to compute the second delay using a result obtained by (i) computing a product of arrangement row and column indices of a speaker among speakers arranged in rows and columns in the speaker matrix and (ii) computing a modulus of the computed product with respect to a prime number.

9. The audio rendering device according to claim 1, wherein the rendering information includes spacing from one of the speakers to another.

10. The audio rendering device according to claim 1, wherein the rendering information includes a total number of the speakers.

11. An audio rendering device which uses multichannel speakers, the device comprising:

a sound splitter which separates an input audio signal into direct and diffuse components;

a direct component rendering unit configured to render the direct components to generate direct components for use in rendering with multichannel speakers;

a first delay computation unit configured to compute, based on rendering information about the multichannel speakers, a first delay which is assigned to each of speakers included in the multichannel speakers and generates a primary wavefront which propagates in a predetermined traveling direction from a sound source that is each of the speakers;

a second delay computation unit configured to compute, based on the rendering information about the multichannel speakers, a second delay which is assigned to each of the speakers and generates, on the primary wavefront, a secondary wavefront synthesized into a scattering wavefront;

a first addition unit configured to add up the first delay and the second delay to compute a total delay for each of the speakers;

a delay filter which applies the total delay to the diffuse components; and a second addition unit configured to add up output from the direct component rendering unit and output from the delay filter, to generate a multichannel signal for use in rendering with the multichannel speakers, and output the multichannel signal to the multichannel speakers.

12. An audio rendering method in which multichannel speakers are used, the method comprising:

computing, based on rendering information about the multichannel speakers, a first delay which is assigned to each of speakers included in the multichannel speakers and generates a primary wavefront which propagates in a predetermined traveling direction from a sound source that is each of the speakers;

computing, based on the rendering information about the multichannel speakers, a second delay which is assigned to each of the speakers and generates, on the primary wavefront, a secondary wavefront synthesized into a scattering wavefront;

adding up the first delay and the second delay to compute a total delay for each of the speakers; and applying the total delay to an input audio signal to generate a multichannel audio signal for use in rendering with the multichannel speakers, and outputting the multichannel audio signal to the multichannel speakers.

13. An integrated circuit which outputs a multichannel audio signal to multichannel speakers, the integrated circuit comprising:

a first delay computation unit configured to compute, based on rendering information about the multichannel speakers, a first delay which is assigned to each of speakers included in the multichannel speakers and generates a primary wavefront which propagates in a predetermined traveling direction from a sound source that is each of the speakers;

a second delay computation unit configured to compute, based on the rendering information about the multichannel speakers, a second delay which is assigned to each of the speakers and generates, on the primary wavefront, a secondary wavefront having a scattering wavefront;

an addition unit configured to add up the first delay and the second delay to compute a total delay for each of the speakers; and a delay filter which applies the total delay to an input audio signal to generate a multichannel audio signal for use in rendering with the multichannel speakers, and outputs the multichannel audio signal to the multichannel speakers.

* * * * *